US008438754B2

(12) United States Patent
Pitkäniemi et al.

(10) Patent No.: US 8,438,754 B2
(45) Date of Patent: May 14, 2013

(54) APPARATUS AND METHOD FOR IMPROVING THE DETACHMENT OF PAPER FROM THE DRYING CYLINDER OF A PAPER MACHINE

(75) Inventors: Ilpo Pitkäniemi, Kotka (FI); Timo Haverinen, Kaarina (FI)

(73) Assignee: EV Group OY, Karhula (FI)

( * ) Notice: Subject to any disclaimer, the term of this patent is extended or adjusted under 35 U.S.C. 154(b) by 281 days.

(21) Appl. No.: 13/061,724

(22) PCT Filed: Aug. 25, 2009

(86) PCT No.: PCT/FI2009/000076

§ 371 (c)(1),
(2), (4) Date: Mar. 2, 2011

(87) PCT Pub. No.: WO2010/026282

PCT Pub. Date: Mar. 11, 2010

(65) Prior Publication Data

US 2011/0154685 A1 Jun. 30, 2011

(30) Foreign Application Priority Data

Sep. 3, 2008 (FI) ..... 20080496

(51) Int. Cl.
*F26B 3/00* (2006.01)

(52) U.S. Cl.
USPC ..... 34/444; 34/456; 34/117; 34/124; 162/358.5

(58) Field of Classification Search ..... 34/380, 34/381, 413, 457, 455, 456, 444, 114, 116, 34/117, 124, 125; 162/193, 198, 202, 358.5, 162/291
See application file for complete search history.

(56) References Cited

U.S. PATENT DOCUMENTS

| | | | | |
|---|---|---|---|---|
| 4,516,330 | A | 5/1985 | Eskelinen et al. | |
| 4,543,160 | A * | 9/1985 | Kerttula et al. | 162/193 |
| 4,553,340 | A | 11/1985 | Petersson | |
| 4,680,873 | A * | 7/1987 | Fellers et al. | 34/116 |
| 4,693,784 | A * | 9/1987 | Aula et al. | 162/202 |
| 4,694,587 | A * | 9/1987 | Eskelinen | 34/457 |
| 5,163,236 | A * | 11/1992 | Heikkila | 34/115 |
| 5,230,776 | A * | 7/1993 | Andersson et al. | 162/290 |

(Continued)

FOREIGN PATENT DOCUMENTS

FI 110625 B1 8/2000

*Primary Examiner* — Stephen M. Gravini
(74) *Attorney, Agent, or Firm* — Birch, Stewart, Kolasch & Birch, LLP

(57) ABSTRACT

The object of the invention is an apparatus and a method for improving the detachment of paper (1) from the cylinder of a paper machine in a drying section implemented with a single wire transfer, which drying section comprises means for heating the paper on the drying cylinder (3) and for transporting it onwards on the wire (2) via a hitch roll (8) to the next drying cylinder such that the paper together with the wire in the section between the cylinders is sucked against the wire by means of low pressure. What is essential to the invention is that in order to improve the detachment of the paper (1) an apparatus is installed on the opposite side of the drying wire (2) at the detachment point (7), which apparatus comprises a nozzle (14), with which an air jet (11) is blown against the direction of travel (15) of the drying wire, and a carrying surface (9) such that the air jet (11) ejects secondary air (17) along with it causing an air flow (18) between the planar carrying surface (9) and the drying wire (2).

20 Claims, 2 Drawing Sheets

U.S. PATENT DOCUMENTS 5,383,288 A * 1/1995 Ilmarinen ..... 34/392
5,600,897 A * 2/1997 Sollinger et al. ..... 34/115
5,782,009 A 7/1998 Kotitschke
6,365,004 B1 * 4/2002 Hamstrom et al. ..... 162/198
6,395,136 B1 * 5/2002 Andersson et al. ..... 162/358.5
6,418,639 B1 * 7/2002 Virta et al. ..... 34/455
6,574,884 B1 * 6/2003 Jokinen ..... 34/114
6,910,282 B1 6/2005 Jokinen et al.
2011/0154685 A1 * 6/2011 Pitkaniemi et al. ..... 34/463

* cited by examiner

APPARATUS AND METHOD FOR IMPROVING THE DETACHMENT OF PAPER FROM THE DRYING CYLINDER OF A PAPER MACHINE

FIELD OF THE INVENTION

The object of the current invention is an apparatus as defined in the preamble of claim 1 for improving the detachment of paper from the cylinder of a paper machine, and also a method for applying the invention as defined in the preamble of claim 6.

BACKGROUND OF THE INVENTION

The object of the invention is an apparatus in the drying section of a paper machine, with which the detachment of paper from the smooth surface of a drying cylinder is improved. The dynamic forces caused by movement and the adhesive attraction between surfaces cause the paper in the cylinder drying section of a paper machine want to follow the surface of the smooth drying cylinder at the point where it is desired that the paper detaches from the surface of the drying cylinder and after that, supported by the next drying wire, to go to the next drying cylinder via a hitch roll. It is endeavored to solve this problem by installing apparatuses that produce low pressure on the side opposite the paper. Conventionally, a low pressure is formed for the whole distance that the paper travels on the surface of the drying wire from the drying cylinder to the hitch roll and to the next cylinder.

As speeds increase, dynamic forces also increase and for this reason there has been a need to raise the level of the low pressure on the backing side of the drying wire, so that the paper remains attached to the drying wire. For this reason one problem, among others, that arises is the bending of the drying wire, because it cannot be tightened too much owing to, in turn, the bending of the rolls.

Apparatuses have been developed to solve the problem, wherein a greater low pressure is formed in particular at the point of detachment of the paper from the cylinder.

The level of prior art generally is described in e.g. patent publications U.S. Pat. No. 5,782,009 and FI-110625B.

In the solution according to publication U.S. Pat. No. 5,782,009 different low pressure areas are formed, which areas are separated by mechanical seals. Low pressure is formed in the detachment area with a dedicated fan/suction apparatus, the area is isolated with mechanical seals from the rest of the area of lower pressure in which, correspondingly, a different low pressure is formed with a fan/suction apparatus dedicated to it. In this way different low pressures are achieved for the detachment area and for the rest of the area.

The solution to the problem is, however, in how the mechanical seals are brought close enough to the drying wire for the low pressure needed to be achieved. If the seals are left too far away, e.g. to prevent mechanical contact, a lot of air must be sucked out in order to achieve an adequately low pressure. Correspondingly a seal that is brought too close easily rubs against the drying wire and wears it until it is unusable.

In the solution according to publication FI-110625B the low-pressure areas are divided into areas of high low-pressure and low low-pressure. The area of high low-pressure is made by blowing air against the direction of travel of the drying wire, which ejects air along with it and forms low pressure in the space behind it. The enhanced low-pressure space is limited either with a mechanical seal pushed towards the drying wire or alternatively with a nozzle blowing in the opposite direction.

In a solution in which the area of greater low-pressure is limited with a mechanical sealing, one problem is adjusting the mechanical sealing to exactly the correct distance. Too great a distance does not produce the necessary pressure difference between the high low-pressure area and the low low-pressure area. Correspondingly, too small a distance causes bending of the wire and rubbing of the seal on the wire.

In an alternative solution, in which a separate nozzle blowing in the direction of travel is used, one problem that arises is the opposing air flows. In this case the sealing implemented with blowing in the direction of travel of the drying wire is subjected to turbulent air flows between the high low-pressure area and the low low-pressure area in the hitch roll zone.

DESCRIPTION OF THE INVENTION

A new solution has now been developed to eliminate the problems of prior art. The characteristic features of the solution according to the invention are defined in more detail in the characterization parts of the attached claims.

In the present invention the connection between the speed of the air and the pressure of the air is exploited.

The apparatus according to the invention comprises a nozzle on the opposite side of the dryer wire at the point of detachment of the paper from the cylinder, from which nozzle an air jet is blown against the direction of travel of the wire. The air jet is guided with the guide surface of the air jet.

A planar carrying surface in the direction of the drying wire is disposed at the same distance from the drying wire as the guide surface of the air jet. This divides the low-pressure area into an enhanced low-pressure area and a weak low-pressure area.

The air jet ejects, i.e. sucks out, the surrounding secondary air along with it from the gap between the drying wire and the planar carrying surface, and thus produces a greater speed for the secondary air between the drying wire and the planar carrying surface. According to Bernoulli's Law, speed increases as static pressure decreases. The speed of the secondary air in the lower area of weak low-pressure is small because it has a greater flow area. When the secondary air flows into the area of enhanced low-pressure, the speed of the secondary air increases, and the static pressure decreases according to the aforementioned Bernoulli's Law. The effective area of the enhanced low-pressure can be adjusted to that desired by dimensioning the length of the planar carrying surface according to need.

DESCRIPTION OF THE DRAWINGS

In the following, the invention will be described in more detail with reference to the attached drawings, wherein:

FIG. 1 presents one drying group of the cylinder drying section implemented with a single wire transfer. The paper 1 is pressed by means of the drying wire 2 against the surface of the drying cylinder 3 where the paper is heated. After this the paper 1 follows the drying wire 2 via the hitch roll 8 to the next drying cylinder while evaporating water into the surrounding air.

Figure 1:
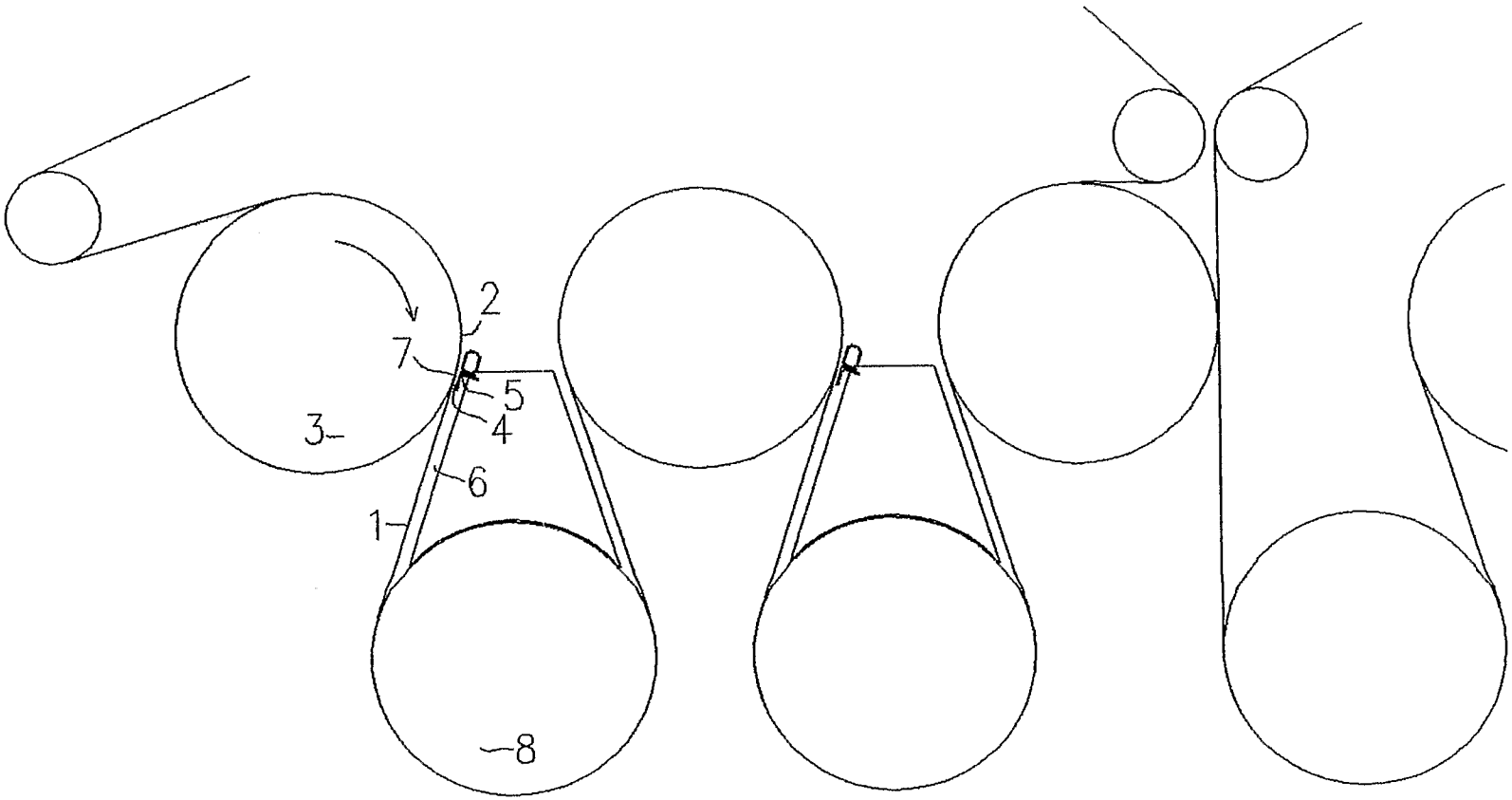
FIG. 1 presents one drying group of the cylinder drying section to which the solution according to the invention is connected.
Figure 2:
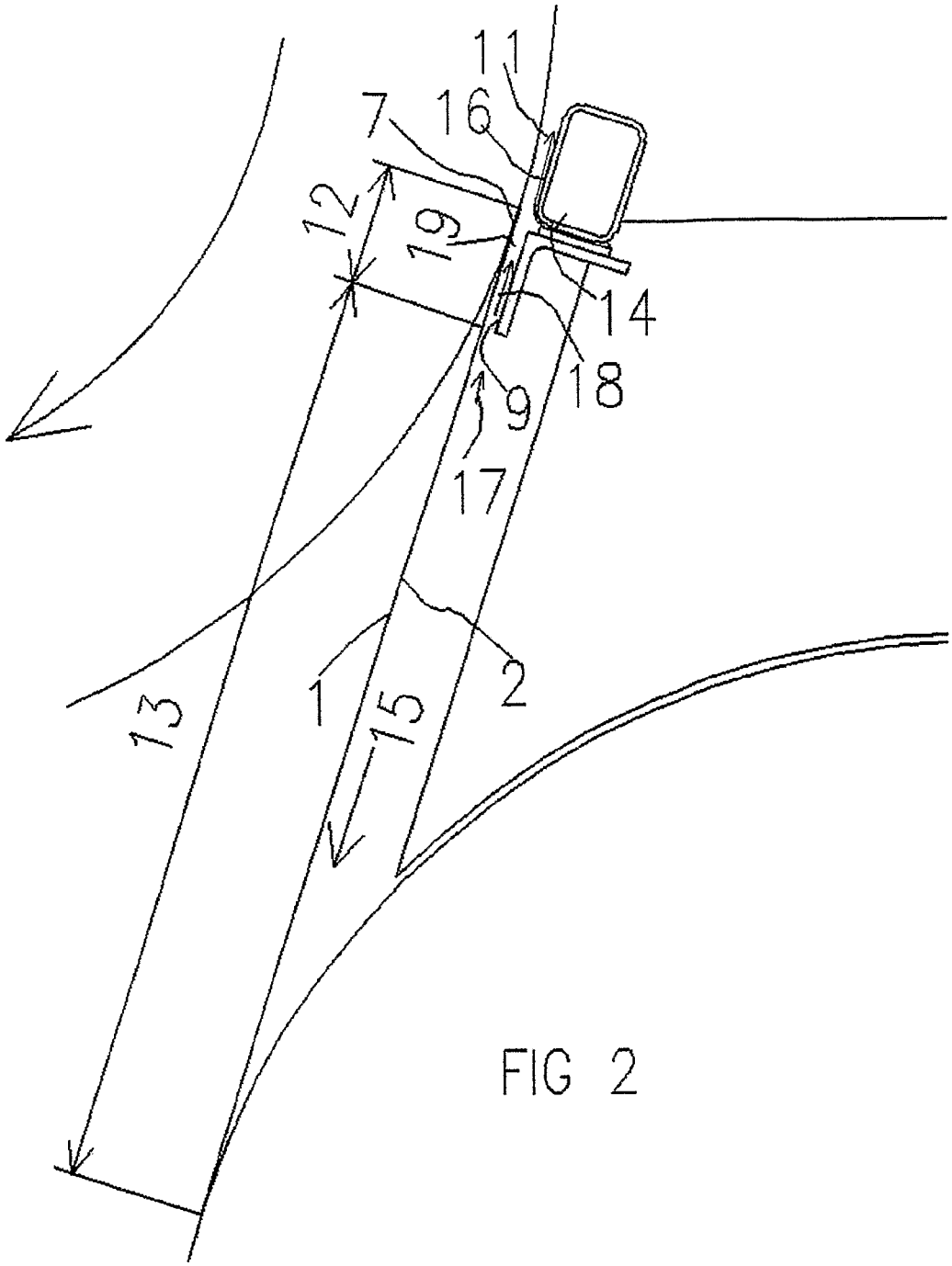
FIG. 2 presents a schematic diagram of the solution according to the invention.

The object of the invention according to FIGS. 1 and 2 is an apparatus in the drying section of a paper machine improving the detachment of paper from the surface of the smooth drying cylinder. The apparatus comprises means for forming low pressure on the opposite side of the drying wire to the paper such that at the detachment point 7 of the paper from the drying cylinder 3 an enhanced low-pressure area 12 is formed for ensuring detachment and in the rest of the area a weaker low-pressure area 13 is formed for keeping the paper 1 attached to the drying wire 2. The apparatus comprises a nozzle 14 for blowing an air jet 11 against the direction of travel of the wire 2 at the detachment point 7 of the paper from the cylinder on the opposite side of the drying wire, and also a planar carrying surface 9 parallel with the drying wire at the same distance 19 from the drying wire as the guide surface 16 of the air jet after the nozzle 14 in the direction of travel of the drying wire. By blowing the air jet 11 against the direction of travel of the drying wire at the point of detachment 7 of the paper from the cylinder on the opposite side of the drying wire, the air jet ejects secondary air along with it, causing an air flow between the planar carrying surface 9 and the drying wire 2. When the secondary air flows from the area 13 of weak low-pressure into the area 12 of enhanced low-pressure, the speed 17 and 18 of the secondary air increases, in which case and the static pressure decreases according to Bernoulli's Law. In this way by increasing the speed 17 and 18 of the secondary air, an area 12 of enhanced low-pressure in the space between the carrying surface 9, which is planar with the drying wire, and the drying wire 2, formed in the area in which the paper is detached from the drying cylinder, is produced, in which case the low pressure that affects the air passing through the wire mesh helps detachment of the paper from the surface of the drying cylinder.

FIG. 2 presents a solution according to the invention according to what is presented above. An air nozzle 14 is disposed on the opposite side of the drying wire 2 at the location of the detachment point 7 of the paper 1 from the drying cylinder, from which nozzle an air jet 11 is directed against the direction of travel 15 of the drying wire. The guide surface 16 of the air jet turns after the nozzle and at a small distance is almost according to the direction of travel of the drying wire. At the same distance from the drying wire 2 as the guide surface 16 of the air jet and after the nozzle in the direction of travel of the drying wire is a planar carrying surface 9 that is parallel with the direction of travel of the drying wire. By means of the length of the planar carrying surface 9 the length of the area of enhanced low-pressure formed is adjusted. Correspondingly, the low pressure of the low low-pressure area 13 is produced by restricting the air flow into the space in question.

By blowing an air jet 11 from the nozzle 14 against the direction of travel of the drying wire, the air jet ejects along with it secondary air from the space around it. The gap 19 between the planar carrying surface 9 and the drying wire is fairly small, preferably in the range 3-10 mm, in which case the speed 18 of the secondary air can be raised to the magnitude desired. When the secondary air flows into the area 12 of enhanced low-pressure, its speed 18 increases as the flow area decreases, and the static pressure decreases according to Bernoulli's Law. Correspondingly, when the secondary air flows in the low low-pressure 13 area, its speed 17 is small.

DETAILED DESCRIPTION OF THE INVENTION

What is essential to the solution according to the invention is that the speed of the air is accelerated near the surface of the wire exactly in the area in which great low-pressure is desired.

The invention relates to an apparatus and a method for improving the detachment of paper 1 from the cylinder of a paper machine in a drying section implemented with a single wire transfer, which drying section comprises means for heating the paper on the drying cylinder 3 and for transporting it onwards on the wire 2 via a hitch roll 8 to the next drying cylinder such that the paper together with the wire in the section between the cylinders is sucked against the wire by means of low pressure.

The characteristic features of the invention are that in order to improve detachment of the paper 1 an apparatus is installed on the opposite side of the drying wire 2 at the detachment point 7, which apparatus comprises a nozzle 14, with which an air jet 11 is blown, as well as a guide surface 16 by means of which the air jet 11 is directed against the direction of travel 15 of the drying wire. In addition, the apparatus comprises a carrying surface 9 such that the air jet 11 ejects along with it secondary air 17 causing an air flow 18 between the planar carrying surface 9 and the drying wire 2.

In the solution according to the invention compressed air in the range 0.3-10 bar is preferably used as the blast air of the air jet 11. In this case the amount of air is sufficient to produce ejection with a small amount of air and smaller pipes are adequate for the air piping than with low-pressure air blowing implemented with a fan.

In theory when the jet is blown into a free space the air jet ejects along with it from its surrounds up to 30 times the amount of secondary air. In the solution according to the invention not enough secondary air is freely available from the surrounds, so that in practice the amount of secondary air ejected from the environs is smaller. With the solution according to the invention it has been proved in tests that the air jet ejects 5-10 times the amount of air along with the secondary air of the environment A suitable distance on the planar carrying surface 9 and on the drying wire 2 is in the range of 3-10 mm, preferably 3-6 mm and most preferably 5 mm. When blowing from a 0.1 mm gap nozzle at a pressure of 1.0 bar with the gap 19 between the planar carrying surface 9 and the drying wire 2 being 5 mm, the speed for the secondary air 17 is 43 m/s, which corresponds to a static pressure of −1100 Pascals.

With the solution according to the invention numerous advantages with respect to prior art are achieved. One advantage is that in possible drying wire contacts the planar carrying surface 9 of the apparatus near the drying wire is not damaged in the same way as the sharp pointed choking means pushed towards a prior-art drying wire. Additionally, the risk of damage to the drying wire decreases when the opposing surface is level.

What is presented above discloses the indisputable advantages of the solution according to the invention, its novelty and its inventive step. It is obvious to the person skilled in the art that the solution according to the invention is not limited solely to the examples described above, but that it may be varied within the scope of the attached claims.

The invention claimed is:

1. Apparatus for improving the detachment of paper (1) from the cylinder of a paper machine in a drying section implemented with a single wire transfer, which drying section comprises means for heating the paper on the drying cylinder (3) and for transporting it onwards on the wire (2) via a hitch roll (8) to the next drying cylinder such that the paper together with the wire in the section between the cylinders is sucked against the wire by means of low pressure and in that the apparatus comprises means for forming low pressure such that an enhanced low- pressure area (12) is formed at the detachment point (7) of the paper (1) and after it with respect to the direction of travel (15) of the drying wire a second weak low-pressure area (13) to keep the paper (1) attached to the drying wire (2), characterized in that to improve the detachment of the paper (1) an apparatus is installed on the opposite side of the drying wire (2) at the detachment point (7), which apparatus comprises a nozzle (14), with which an air jet (11) is blown, and a guide surface (16) by means of which the air jet (11) is directed against the direction of travel (15) of the drying wire such that the air jet (11) ejects secondary air (17) along with it causing an air flow (18) between the planar carrying surface (9) and the drying wire (2).

2. Apparatus according to claim 1, characterized in that with respect to the direction of travel (15) of the drying wire, the planar carrying surface (9) of the apparatus is installed after the nozzle (14) at essentially the same distance (19) as the guide surface (16) of the air jet (11).

3. Apparatus according to claim 1, characterized in that the distance of the gap (19) between the carrying surface (9) and the drying wire (2) is 3-10 mm.

4. Apparatus according to claim 1, characterized in that the guide surface (16) is parallel with the planar carrying surface (9) with respect to the direction of travel (15) of the drying wire (2).

5. Apparatus according to claim 1, characterized in that the guide surface (16) of the air jet (11) turns after the nozzle (14) according to the direction of travel of the drying wire (2).

6. Method for improving the detachment of paper (1) from the cylinder of a paper machine in a drying section implemented with a single wire transfer, wherein the paper is heated on the drying cylinder (3) and transported onwards in connection with the wire (2) via a hitch roll (8) to the next drying cylinder such that the paper together with the wire in the section between the cylinders is sucked against the wire by means of low pressure and in that in the method an enhanced low-pressure area (12) is formed at the detachment point (7) of the drying wire (2) for ensuring detachment and a second weak low-pressure area (13) with respect to the direction of travel (15) of the drying wire is formed to keep the paper (1) attached to the drying wire (2), characterized in that in the method an air jet (11) is blown with a nozzle (14) on the opposite side of the drying wire (2) at the detachment point (7) of the paper and is guided by means of a guide surface (16) against the direction of travel (15) of the drying wire such that the air jet (11) ejects secondary air (17) along with it causing an air flow (18) between the planar carrying surface (9) and the drying wire (2).

7. Method according to claim 6, characterized in that in the method when the flow speed of the secondary air increases (17 and 18) an enhanced low-pressure area (12), in which the paper (1) is detached from the cylinder, formed in the area between the planar carrying surface (9) and the drying wire (2), is produced.

8. Method according to claim 6, characterized in that in the method with a flow (18) of secondary air (17) and by means of a carrying surface (9) different low-pressure areas (12) and (13) are formed and also the channeling of leakage air into the area (13) is prevented.

9. Method according to claim 6, characterized in that in the method the distance of the gap (19) between the carrying surface (9) and the drying wire (2) is 3-10 mm.

10. Method according to claim 6, characterized in that in the method the guide surface (16) is parallel with the planar carrying surface (9) with respect to the direction of travel (15) of the drying wire (2).

11. Method according to claim 6, characterized in that in the method the distance of the gap (19) of the guide surface (16) and of the carrying surface (9) from the wire (2) is essentially the same.

12. Method according to claim 6, characterized in that in the method the guide surface (16) of the air jet (11) turns after the nozzle (14) essentially according to the direction of travel of the drying wire (2).

13. Apparatus according to claim 2, characterized in that the distance of the gap (19) between the carrying surface (9) and the drying wire (2) is 3-10 mm.

14. Apparatus according to claim 2, characterized in that the guide surface (16) is parallel with the planar carrying surface (9) with respect to the direction of travel (15) of the drying wire (2).

15. Apparatus according to claim 3, characterized in that the guide surface (16) is parallel with the planar carrying surface (9) with respect to the direction of travel (15) of the drying wire (2).

16. Apparatus according to claim 2, characterized in that the guide surface (16) of the air jet (11) turns after the nozzle (14) according to the direction of travel of the drying wire (2).

17. Apparatus according to claim 3, characterized in that the guide surface (16) of the air jet (11) turns after the nozzle (14) according to the direction of travel of the drying wire (2).

18. Apparatus according to claim 4, characterized in that the guide surface (16) of the air jet (11) turns after the nozzle (14) according to the direction of travel of the drying wire (2).

19. Method according to claim 7, characterized in that in the method with a flow (18) of secondary air (17) and by means of a carrying surface (9) different low-pressure areas (12) and (13) are formed and also the channeling of leakage air into the area (13) is prevented.

20. Method according to claim 7, characterized in that in the method the distance of the gap (19) between the carrying surface (9) and the drying wire (2) is 3-10 mm.

* * * * *